US007934449B2

(12) United States Patent
Anderson et al.

(10) Patent No.: US 7,934,449 B2
(45) Date of Patent: May 3, 2011

(54) SERVING TRAY AND FOOD CONTAINER

(75) Inventors: Brent W. Anderson, Alpharetta, GA (US); Daniel Lee Bizzell, Davidson, NC (US); Russ Stanziale, Cumming, GA (US); Ian D. Kovacevich, Charlotte, NC (US); Louis J. Foreman, Huntersville, NC (US)

(73) Assignee: Edison Nation, LLC, Charlotte, NC (US)

( * ) Notice: Subject to any disclaimer, the term of this patent is extended or adjusted under 35 U.S.C. 154(b) by 1274 days.

(21) Appl. No.: 11/464,399

(22) Filed: Aug. 14, 2006

(65) Prior Publication Data

US 2007/0062965 A1 Mar. 22, 2007

Related U.S. Application Data

(60) Provisional application No. 60/596,367, filed on Sep. 19, 2005.

(51) Int. Cl.

| | |
|---|---|
| ***A22C 7/00*** | (2006.01) |
| ***A23P 1/00*** | (2006.01) |
| ***A47J 43/18*** | (2006.01) |

(52) U.S. Cl. ..... 99/426; 220/23.8; 220/575; 220/574.2; 220/281; 206/565; 206/508; D7/601; D7/505; D7/540; D7/553.6

(58) Field of Classification Search ..... 206/565, 206/508; 99/426; D7/601

See application file for complete search history.

(56) References Cited

U.S. PATENT DOCUMENTS

| | | | | |
|---|---|---|---|---|
| D31,737 | S | 10/1899 | Bardwell | |
| 875,549 | A | 12/1907 | Mitchell | |
| 943,162 | A | 12/1909 | Schlesinger | |
| 947,373 | A | 1/1910 | Coleman | |
| 948,434 | A | 2/1910 | Scoot | |
| 1,048,546 | A | 12/1912 | Ketchum | |
| D67,011 | S | 4/1925 | Clarke | |
| 1,595,356 | A | 8/1926 | Moseman | |
| 1,768,976 | A * | 7/1930 | Cuthbertson | 220/575 |
| 1,832,585 | A | 11/1931 | Sample | |
| 1,858,728 | A | 5/1932 | Creighton | |
| 2,034,478 | A | 3/1936 | Levy | |

(Continued)

FOREIGN PATENT DOCUMENTS

CA 2510098 A1 * 12/2006

OTHER PUBLICATIONS

Information Disclosure Statement (IDS) Letter Regarding Common Patent Application(s), submitted by Applicant on Oct. 15, 2009.
Information Disclosure Statement (IDS) Letter Regarding Common Patent Application(s), submitted by Applicant on Mar. 30, 2010.
Information Disclosure Statement (IDS) Letter Regarding Common Patent Application(s) submitted by Applicant on Dec. 16, 2010.

*Primary Examiner* — Sang Y Paik
*Assistant Examiner* — Brett Spurlock
(74) *Attorney, Agent, or Firm* — Chad D. Tillman; James D. Wright; Tillman Wright, PLLC

(57) ABSTRACT

A food tray assembly includes a serving platter and a receptacle platter. The serving platter has a central aperture extending there through and a serving area defined between the central aperture and a perimeter thereof. The receptacle platter has a bottom and a peripheral wall extending from the bottom at a perimeter thereof. The serving platter and the receptacle platter are releasably coupled to one another.

18 Claims, 15 Drawing Sheets

U.S. PATENT DOCUMENTS 2,050,206 A 8/1936 Chaplin
2,096,825 A 10/1937 Roman
2,322,665 A 6/1943 Ryan
D154,224 S 6/1949 Tweet
D160,688 S 10/1950 Brock
2,641,912 A 6/1953 Lawler
2,738,915 A 3/1956 St. Clair
D179,780 S 2/1957 Randall
2,781,651 A * 2/1957 Cutler ..... 248/346.11
D185,911 S 8/1959 Chadbourne et al.
2,897,974 A 8/1959 Cook
2,951,610 A 9/1960 Smalley
3,028,038 A 4/1962 Van Wyngarden
3,051,303 A 8/1962 Daanen et al.
3,051,346 A 8/1962 Grogel
3,099,377 A 7/1963 Metzler et al.
3,142,409 A * 7/1964 Ross ..... 220/281
D198,804 S 8/1964 Shepley
D206,762 S 1/1967 Kirwan
3,305,126 A 2/1967 Cease
D209,769 S 1/1968 Bateman
3,398,827 A 8/1968 Laskin
D212,639 S 11/1968 Schilling
3,511,288 A 5/1970 Swett et al.
3,532,247 A 10/1970 Bridges
3,601,277 A 8/1971 Andrews et al.
D221,883 S 9/1971 Cash
D225,050 S 11/1972 Cannell
3,756,462 A 9/1973 Cain
D230,001 S 1/1974 Wright
3,799,386 A 3/1974 Madalin et al.
D231,302 S 4/1974 Lukawski
3,811,594 A 5/1974 Paulucci
D232,294 S 8/1974 Christian et al.
D237,344 S 10/1975 Whitten
3,938,688 A 2/1976 Ryan
D250,315 S 11/1978 Otto
4,160,505 A 7/1979 Rauschenberger
4,206,845 A * 6/1980 Christian ..... 206/508
4,280,336 A * 7/1981 Taylor ..... 62/457.5
4,351,164 A 9/1982 Christiani
D268,317 S 3/1983 Wyatt
D285,638 S 9/1986 Trivison
D286,360 S 10/1986 Trivison
4,653,685 A 3/1987 Leary et al.
4,660,716 A 4/1987 McMahon et al.
D291,042 S 7/1987 Fahey et al.
4,732,274 A 3/1988 Bouton
D295,261 S 4/1988 Wetter
D300,101 S 3/1989 Ritman
4,838,444 A 6/1989 Bitel
D302,068 S 7/1989 Forbes et al.
4,865,219 A 9/1989 Logan et al.
4,874,083 A 10/1989 Antoni et al.
D304,658 S 11/1989 Mattei
D312,026 S 11/1990 Antoni et al.
4,995,557 A 2/1991 Fremion
5,040,681 A 8/1991 Grusin
5,097,753 A 3/1992 Naft
5,150,804 A 9/1992 Blanchet et al.
5,261,554 A 11/1993 Forbes
5,271,508 A 12/1993 Gamwell
D346,554 S 5/1994 Krupa
D351,087 S 10/1994 Anderson
D352,204 S 11/1994 Hayes et al.
5,379,934 A 1/1995 Lorenz
D360,112 S 7/1995 McEntee
D364,090 S 11/1995 Krupa
D366,395 S 1/1996 Wyatt et al.
D368,409 S 4/1996 Schwartz
D373,954 S 9/1996 Wolff
D375,259 S 11/1996 Whitehead
5,593,062 A 1/1997 Martin
5,732,847 A 3/1998 Caldi
D399,095 S 10/1998 Schmidt
D401,810 S 12/1998 Swift
5,869,120 A * 2/1999 Blazevich ..... 426/132
5,894,944 A 4/1999 Swift
5,915,581 A 6/1999 Pfirrmann et al.
D415,025 S 10/1999 McCann
5,988,045 A 11/1999 Housley
6,006,943 A 12/1999 Laney
D420,285 S 2/2000 Sagan et al.
6,022,571 A 2/2000 Blazevich
6,042,856 A 3/2000 Sagan et al.
D426,110 S 6/2000 Schmidt
6,116,455 A 9/2000 Rossman et al.
6,152,318 A 11/2000 Walker
6,168,813 B1 1/2001 Blazevich
D449,966 S 11/2001 Demars
D450,580 S 11/2001 Littlejohn et al.
6,315,126 B1 11/2001 Cornelissen
D455,652 S 4/2002 Wyslotsky et al.
6,371,470 B1 4/2002 Ward
6,398,071 B1 6/2002 Fellers
6,401,927 B1 6/2002 Sorensen et al.
D460,897 S * 7/2002 Leuenberger ..... D7/553.8
D461,099 S * 8/2002 Leuenberger ..... D7/541
6,439,388 B1 8/2002 Lerner
D467,497 S 12/2002 Liu et al.
D468,202 S 1/2003 Chou
6,514,548 B2 2/2003 Lin
6,550,630 B1 4/2003 Krupa
6,595,366 B1 7/2003 Brown
D482,283 S 11/2003 Wichmann et al.
D489,972 S 5/2004 Lin
6,783,017 B2 8/2004 Griffin
D496,831 S 10/2004 Strahota et al.
D511,273 S 11/2005 Hadeler
D516,867 S 3/2006 Martin et al.
D516,912 S 3/2006 LaMansey
D516,913 S 3/2006 LaMansey
7,025,213 B2 4/2006 Chen
7,083,818 B2 8/2006 Pratte
D527,954 S 9/2006 Roth
7,114,630 B2 10/2006 Dege et al.
D546,672 S 7/2007 Chou
D547,185 S 7/2007 Tanaka
7,326,428 B2 2/2008 Weir
7,428,864 B2 9/2008 Wengrovsky
7,438,200 B1 10/2008 Keitges
D581,781 S 12/2008 Enriquez
D586,623 S 2/2009 Dunn
D587,529 S 3/2009 Pratt
D600,499 S 9/2009 Bizzell et al.
D600,500 S 9/2009 Bizzell et al.
D600,501 S 9/2009 Bizzell et al.
D609,973 S 2/2010 Shew et al.
D611,340 S 3/2010 Bizzell
2003/0136699 A1 7/2003 McNeeley et al.
2004/0031799 A1 2/2004 Dege et al.
2004/0056036 A1 3/2004 Tsai
2004/0238438 A1 12/2004 Chen
2005/0145638 A1 7/2005 Van Handel et al.
2005/0161424 A1 7/2005 Hogan
2005/0229793 A1 10/2005 Wengrovsky
2008/0029426 A1 2/2008 Anderson et al.
2008/0029427 A1 2/2008 Anderson et al.
2008/0083759 A1 4/2008 Anderson et al.
2008/0083760 A1 4/2008 Anderson et al.
2008/0110914 A1 5/2008 Anderson et al.
2008/0121550 A1 5/2008 Anderson et al.
2008/0121551 A1 5/2008 Anderson et al.
2008/0121552 A1 5/2008 Anderson et al.
2008/0124440 A1 5/2008 Anderson et al.
2008/0128313 A1 6/2008 Anderson et al.
2008/0173566 A1 7/2008 Lowenstein
2008/0279988 A1 11/2008 Schechter
2009/0200194 A1 8/2009 Kovacevich et al.
2009/0200195 A1 8/2009 Kovacevich et al.
2009/0200196 A1 8/2009 Kovacevich et al.
2009/0200197 A1 8/2009 Kovacevich et al.
2009/0200316 A1 8/2009 Kovacevich et al.
2009/0200701 A1 8/2009 Kovacevich et al.
2010/0044265 A1 2/2010 Ragsdale et al.

* cited by examiner

SERVING TRAY AND FOOD CONTAINER

I. CROSS-REFERENCE TO RELATED APPLICATIONS

The present application is a nonprovisional of and claims priority under 35 U.S.C. §119(e) to Anderson U.S. Provisional Patent Application No. 60/596,367 filed Sep. 19, 2005. The entire disclosure of this patent application is hereby incorporated herein, and a copy of this provisional patent application is attached hereto as an appendix and incorporated herein by reference.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

Trays for snacks and appetizer-type foods are generally known. Such trays provide a place to display these foods for presentation and for eating. They also generally make it easier to transport these foods. Unfortunately, many trays do not have sealing lids that enable transport from one location to another, e.g., from a restaurant to a home. Therefore, when foods that are traditionally presented on a tray are transported from one location to another, a container other than the tray is generally used for transport.

Another problem that exists, particularly for foods such as chicken wings that create their own waste, is finding a place to put the waste prior to its being thrown away. In most cases, a trash receptacle is not located within easy reach of a table or other dining area, typically because it is unsanitary or unsightly. As such, a diner is faced with the problem of having a place to put the waste while the food creating the waste is being eaten. Generally, such waste is unappetizing and an eater would prefer to have the waste out of sight while continuing to eat. Presently available trays do not provide this capability.

IV. SUMMARY OF THE INVENTION

The present invention includes many aspects and features. In a first aspect, a food tray assembly comprises a serving platter and a receptacle platter. The serving platter has a central aperture disposed there through and a serving area defined between the central aperture and a perimeter of the serving platter. The receptacle platter has a bottom and a peripheral wall extending from said bottom at a perimeter of the receptacle platter. The serving platter and receptacle platter are releasably coupled to one another.

In a feature of this aspect, the serving area of the serving platter includes a plurality of radial channels. In accordance with this feature each channel of the plurality of radial channels is adapted to accept and retain more than one individual food item. With regard to this feature, the plurality of radial channels collectively cover the whole of the serving area. With further regard to this feature, the serving area preferably includes four, twelve, or fifteen radial channels.

In another feature of this aspect, the serving platter includes a plurality of drain openings disposed adjacent the perimeter thereof. In an additional feature of this aspect, the serving platter further comprises a wall defining and forming the periphery of the central aperture. In yet another feature, the central aperture is sized such that a container holding sauce for food disposed on the serving platter may be supported therein.

In an additional feature, the bottom of the receptacle platter includes a central generally planar area. With regard to this feature, the bottom of the receptacle platter includes a plurality of indentations circumferentially located between the central generally planar area and the receptacle platter perimeter. It is preferred that the plurality of indentations are generally triangular with a base of the triangle adjacent the receptacle platter perimeter. In a further feature, the bottom of the receptacle includes a central raised portion.

In another feature, the serving platter and receptacle platter are releasably coupled at the serving platter perimeter and a rim of the receptacle platter peripheral wall. In accordance with this feature, when the serving platter and the receptacle platter are coupled, the receptacle platter is disposed below the serving platter. It is preferred that the serving platter includes an underside and the receptacle platter includes an interior side, whereby when the receptacle platter is disposed below the serving platter, the underside of the serving platter is disposed in opposing facing relation with the interior side of the receptacle platter. With regard to another feature, when the serving platter and the receptacle platter are coupled, the receptacle platter is disposed above the serving platter. It is preferred that the serving platter includes a serving side and the receptacle platter includes an interior side, whereby when the receptacle platter is disposed above the serving platter, the serving side of the serving platter is disposed in opposing facing relation with the interior side of the receptacle platter. It is further preferred that when the serving platter and receptacle platter are coupled, the bottom of the receptacle platter is adjacent a peripheral wall of the central aperture of the serving platter.

In yet another feature, the serving platter includes a raised lip adjacent the perimeter thereof. In a further feature, the receptacle platter includes a raised lip at a rim of the peripheral wall of the receptacle platter. It is preferred that the raised lip of the receptacle platter is configured to releasably couple in a friction fit with a raised lip adjacent the perimeter of the serving platter.

In an additional feature, the serving platter includes a tab extending from a perimeter thereof. In another feature, the receptacle platter includes a tab extending from a rim of the peripheral wall. In a further feature, the serving area of the serving platter slopes downwardly from the central aperture to the perimeter thereof.

In another aspect of the invention, a food tray assembly comprises a serving platter and a receptacle platter having a bottom and a peripheral wall extending from the bottom at a perimeter thereof. The receptacle platter may be releasably coupled to said serving platter in two configurations: a serving configuration, wherein the receptacle platter is disposed below the serving platter; and a transport configuration, wherein the receptacle platter is turned upside down relative to the serving configuration and disposed over the serving platter to provide a lid for the food tray assembly during transport.

In a feature of this aspect, the serving platter includes a raised lip adjacent a perimeter thereof. In another feature of this aspect, the receptacle platter includes a raised lip at a rim of the peripheral wall thereof. It is preferred that the raised lip of the receptacle platter is configured to releasably couple in a friction fit with a raised lip adjacent the perimeter of the serving platter.

In an additional feature, the serving platter includes a plurality of radial channels. In yet another feature, a serving area of the serving platter slopes downwardly from a center of the serving plate to a perimeter thereof.

In an additional aspect of the invention, a method of disposing of food waste comprises providing a food tray assembly including a serving platter having a central aperture disposed there through and having a serving area defined between the central aperture and a perimeter thereof, and a receptacle platter having a bottom and a peripheral wall extending from said bottom at a perimeter thereof. When the serving platter and the receptacle platter are releasably coupled to one another at the perimeters thereof, respectively. The method further comprises arranging, on the serving area of the serving platter, food that creates food waste when eaten; and after eating the food, thereby creating the food waste, placing the food waste in the central aperture of the serving platter, whereby the food waste is collected in the receptacle platter.

In a feature of this aspect, the food is chicken wings and said food waste is bones from said chicken wings.

In addition to the aforementioned aspects and features of the present invention, it should be noted that the present invention further includes the various possible combinations of such aspects and features.

V. BRIEF DESCRIPTION OF THE DRAWINGS

Further aspects, features, embodiments, and advantages of the present invention will become apparent from the following detailed description with reference to the drawings, wherein.

Figure 15:
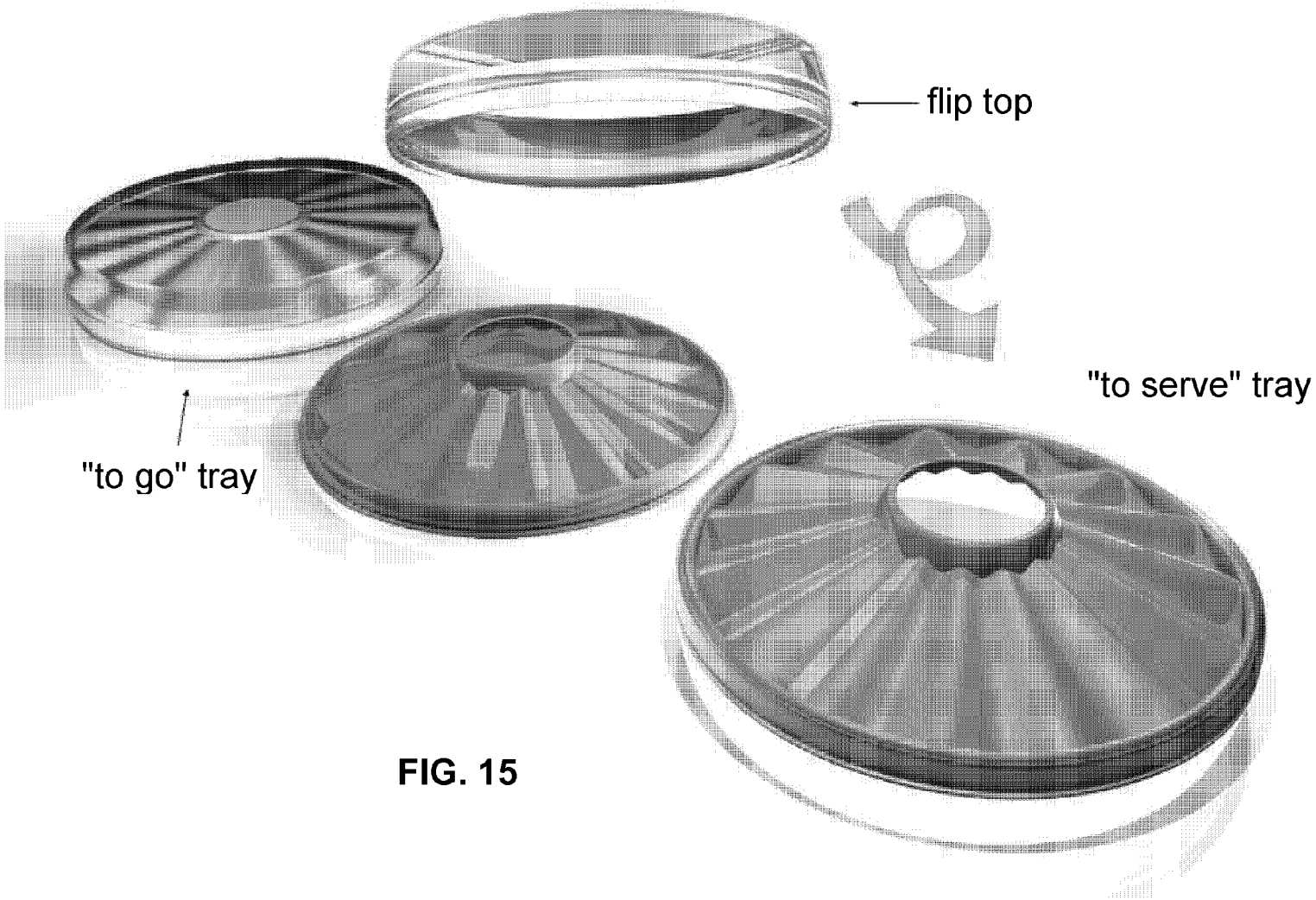
Figure 16:
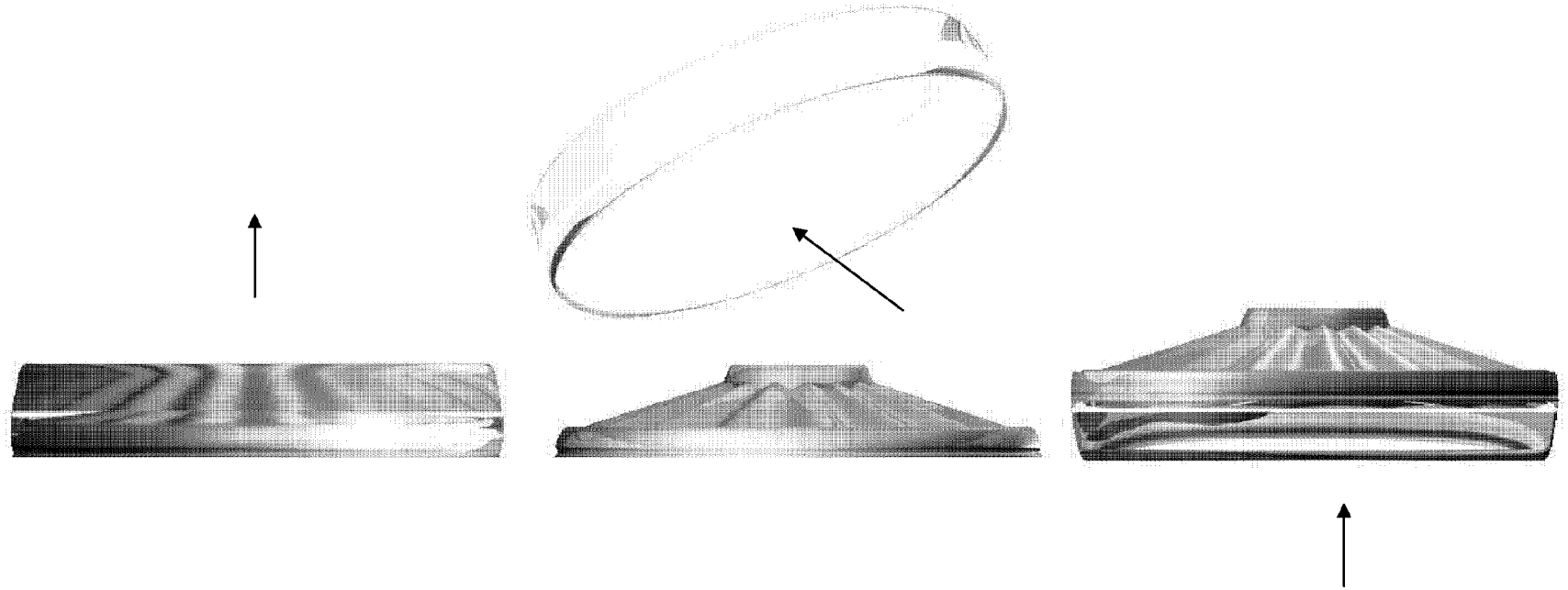

FIG. 15 includes perspective views of another preferred embodiment in accordance with the present invention;

FIG. 16 includes elevational views of the embodiment of FIG. 15; and

Figure 17:
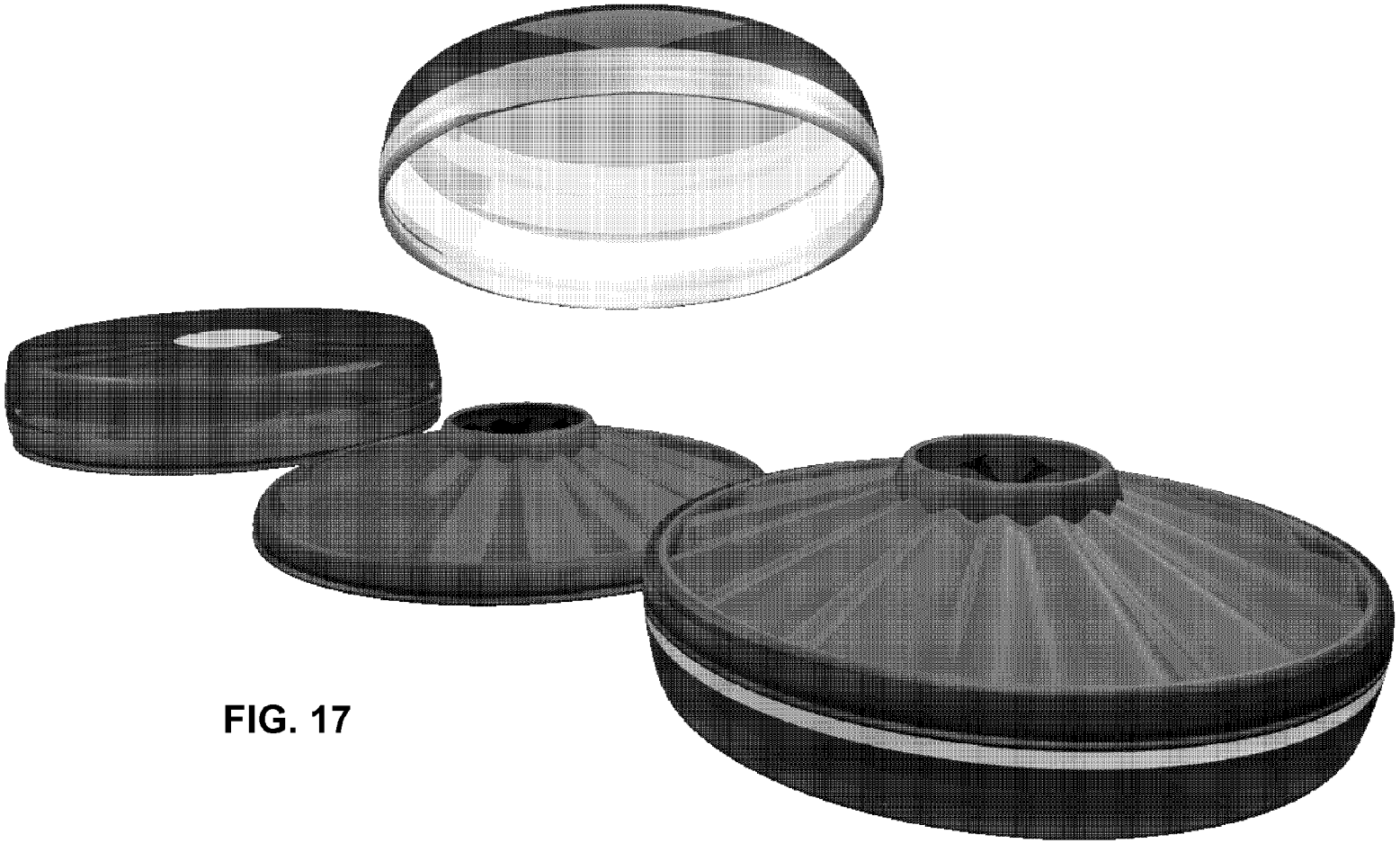

FIG. 17 includes perspective views of a serving tray in accordance with another preferred embodiment of the invention corresponding to the views of FIG. 15.

VI. DETAILED DESCRIPTION

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple"

describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, the preferred embodiments of the present invention are next described. The following description of the preferred embodiment(s) is merely exemplary in nature and is in no way intended to limit the invention, its application, or uses.

Figure 1:
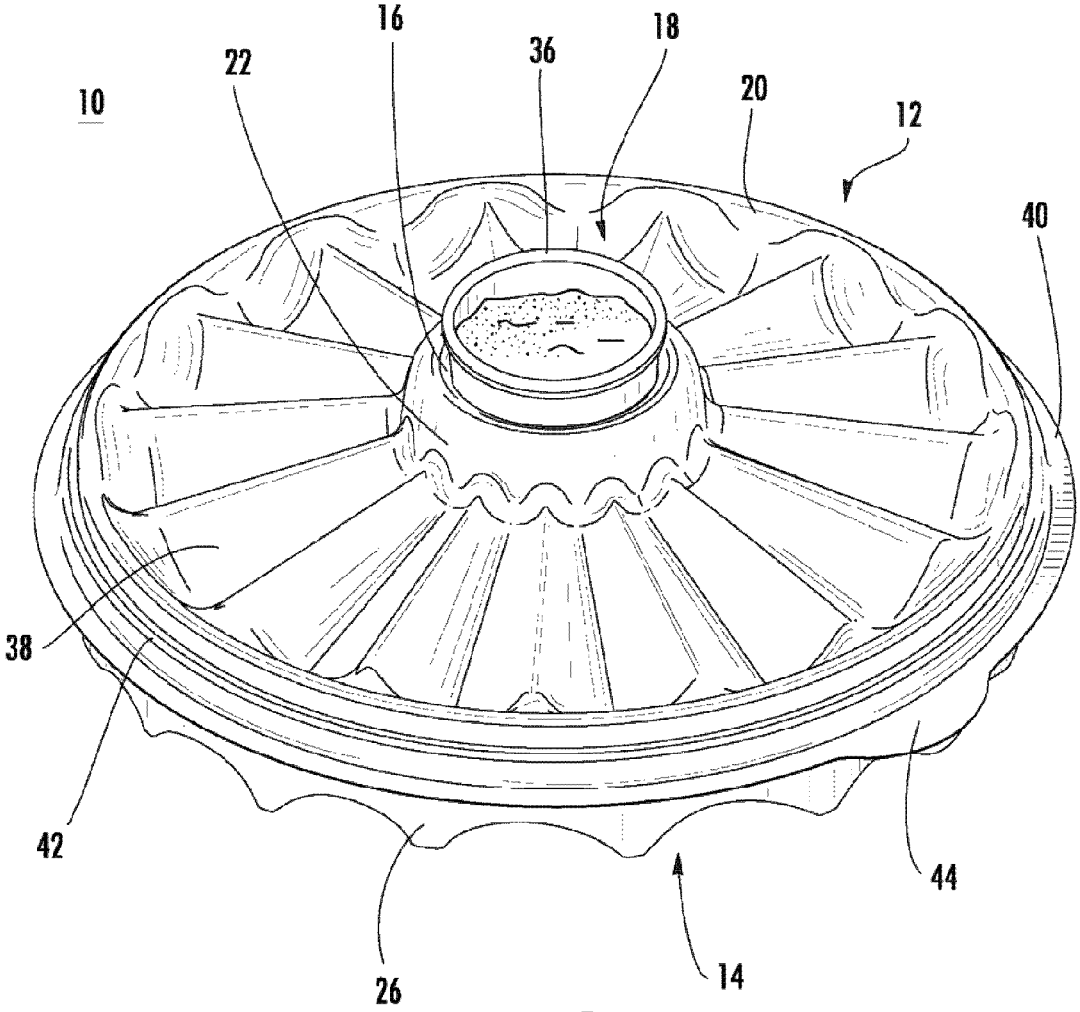
FIG. 1 is a perspective view of a food tray assembly, shown in a serving configuration, in accordance with a preferred embodiment of the present invention.

FIG. 1 is a perspective view of a food tray assembly 10, shown in a serving configuration, in accordance with a preferred embodiment of the present invention. The food tray assembly 10 includes a serving platter 12 and a receptacle platter 14 that may be releasably coupled to each other in a plurality of ways, as described herein below, depending on the configuration in which the food tray assembly 10 is to be used. For example, when in the serving configuration shown in FIG. 1, the serving platter 12 is coupled to the top of the receptacle platter 14.

The food tray assembly 10 may be used to serve and transport food items, particularly appetizer-type food items that create their own waste, naturally or otherwise. An example of such a food item is chicken wings. Additional food items may include tail-on shrimp or food items for which toothpicks are to be utilized as an assembly tool or utensil, such as meatballs. Many times such food items are served with a dipping sauce of some sort. As shown in FIG. 1, a container 36 for dipping sauce may be carried on the serving platter 12 for serving convenience.

Figure 2:
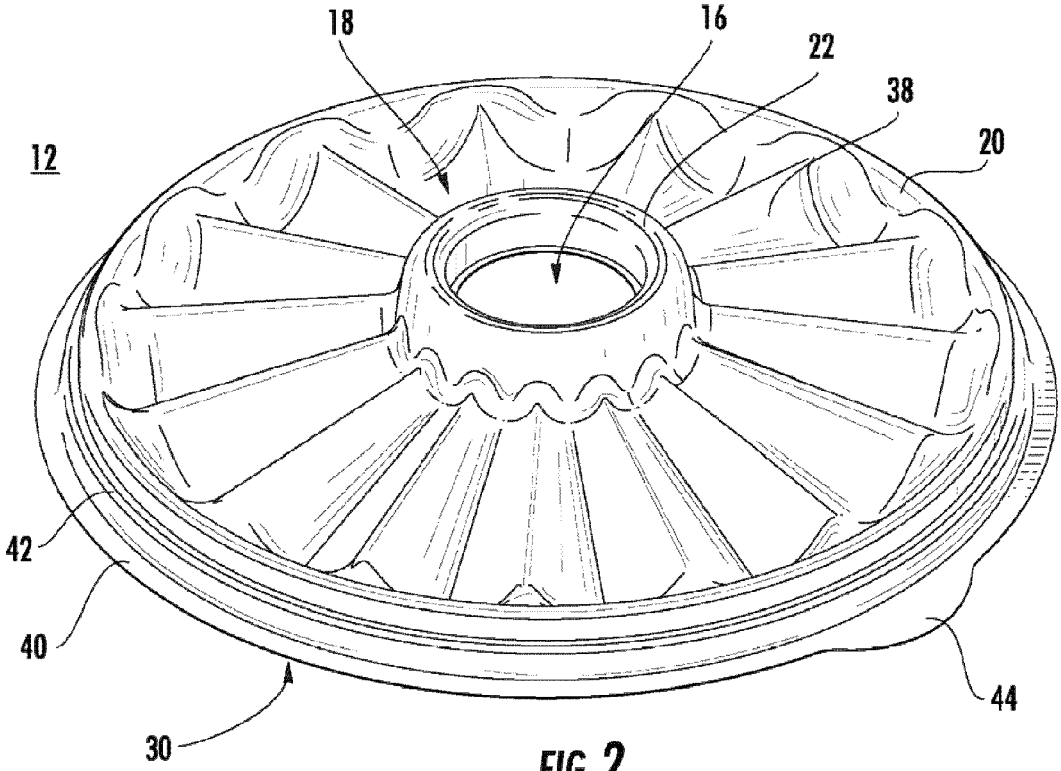
FIG. 2 is a perspective view of the serving platter of the food tray assembly of FIG. 1.

FIG. 2 is a perspective view of the serving platter 12 of the food tray assembly 10 of FIG. 1. With reference to FIGS. 1 and 2, the serving platter 12 in at least one preferred embodiment is circular and has a central aperture 16 penetrating there through and surrounded by a peripheral wall 22. In at least one preferred commercial embodiment, the central aperture 16 is approximately two and one half inches in diameter. As shown in FIG. 1, the serving tray assembly 10 optionally may include the container 36 for dipping sauce, and the container 36 may be sized to conveniently fit within the central aperture 16 of the serving platter 12.

The serving platter 12 also has a serving area 18 defined between the peripheral wall 22 of the central aperture 16 and the perimeter 20 of the serving platter 12. The serving area includes a plurality of radial channels 38. The serving platter 12 further includes a lip 40 having a raised portion 42 disposed at the perimeter 20 of the serving platter 12 and a separation tab 44 disposed at a location adjacent the lip 40. It is preferred that the radial channels 38 encompass the entire serving area 18. The radial channels 38 start at the peripheral wall 22 of the central aperture 16 and terminate at the raised portion 42 of the lip 40 of the serving platter 12. Each of the radial channels 38 slopes downwardly from the central aperture 16. Accordingly, the channels 38 are shallowest at their starting points and are deepest at their termination points. In at least one preferred commercial embodiment, each channel 38 is approximately one inch across at its starting point and two inches across at its termination point.

Each channel 38 is adapted to accept and retain one or more individual food items, for example, one or more chicken wings. Because many food items are traditionally sold in relatively standard amounts, the number of radial channels 38 in the serving area 18 preferably corresponds to the number of items being sold. For example, for a food tray assembly 10 intended for use with chicken wings, which are often sold by the dozen, the serving platter 12 preferably includes twelve radial channels 38, thereby accommodating a dozen chicken wings. Moreover, in at least one preferred commercial embodiment, illustrated herein, the serving platter 12 includes fifteen radial channels 38. In the exemplary embodiment wherein chicken wings are served on the serving platter, having fifteen radial channels enables the serving platter 12 to hold a dozen chicken wings as well as the traditional accoutrements of celery and carrots in the additional three channels. In an alternative embodiment (not shown), the serving platter preferably includes four radial channels. Further, in an embodiment wherein each radial channel 38 may hold more than one food item, e.g., chicken wings, a serving platter 12 with a dozen channels may hold more than a dozen chicken wings.

Figure 3:
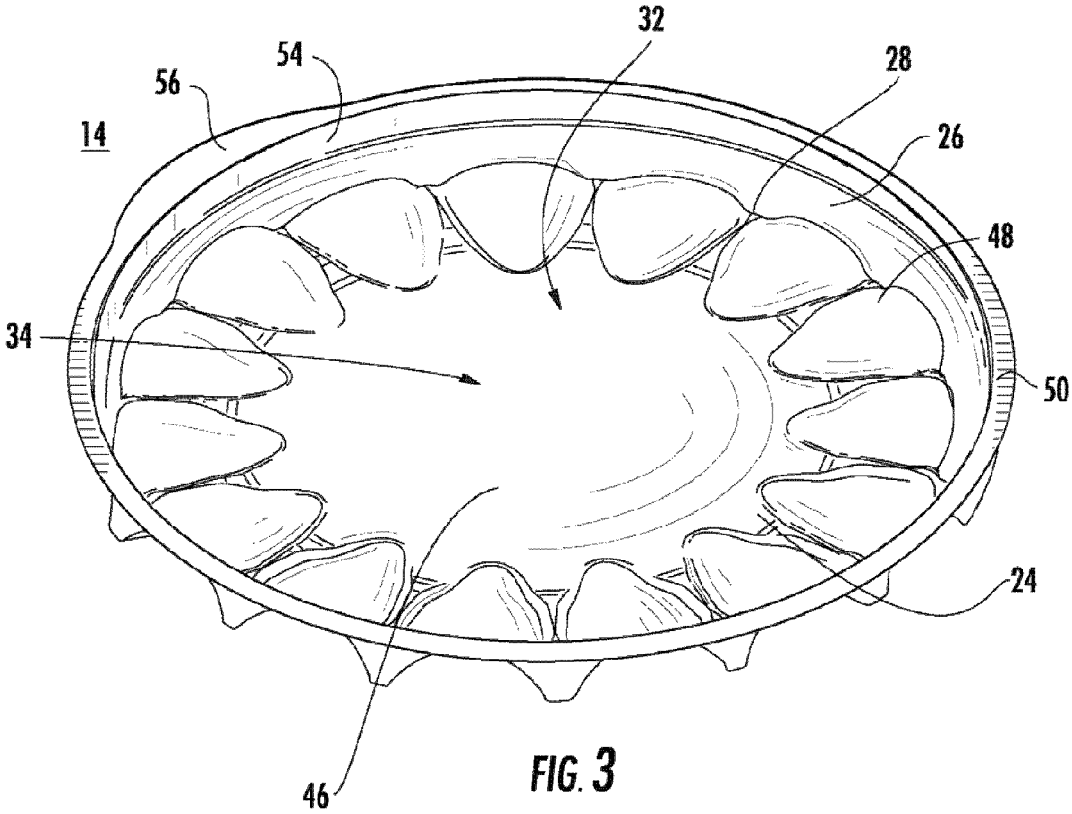
FIG. 3 is a perspective view of the receptacle platter of the food tray assembly of FIG. 1.

FIG. 3 is a perspective view of the receptacle platter 14 of the tray assembly 10 of FIG. 1, shown removed from the bottom of the serving platter 12. The receptacle platter 14 has a bottom 24 and a peripheral wall 26 extending from said bottom 24 at a perimeter 28 thereof. The bottom 24 of the receptacle platter 14 includes a generally planar central area 46 and a plurality of indentations 48 circumferentially located adjacent the perimeter 28 of the bottom 24. Preferably, the plurality of indentations 48 are generally triangular in shape, with rounded edges, and with a base of the triangle adjacent the perimeter 28 of the bottom 24. The receptacle platter 14 further includes a lip 50 having a raised portion 52 (shown in FIG. 1) at a rim 54 of the receptacle platter peripheral wall 26. In addition, the receptacle platter 14 includes a separation tab 56 disposed at a location adjacent the receptacle platter lip 50.

The bottom 24 of the receptacle platter 14 may be dome shaped such that any waste received therein will move toward the perimeter 28 of the bottom 24 rather than piling in the central area 46. Distribution of waste toward the perimeter 28 will tend to avoid any piling of waste in the central area 46. Further, such distribution will tend to evenly balance the weight of the serving platter 12 when the food tray assembly 10 is carried after use.

As stated previously, the food tray assembly 10 is shown in a serving configuration in FIG. 1. This configuration is defined by the receptacle platter 14 being disposed below the serving platter 12 relative to a surface, such as a table or counter, on which the food tray assembly 10 may be placed. In this configuration, an underside 30 of the serving platter 12 is in opposing facing relation with an interior bottom surface 32 of the receptacle platter 14. In the serving configuration, a void space 34 is present between the underside 30 of the serving platter 12 and the interior bottom surface 32 of the receptacle platter 14.

Figure 4:
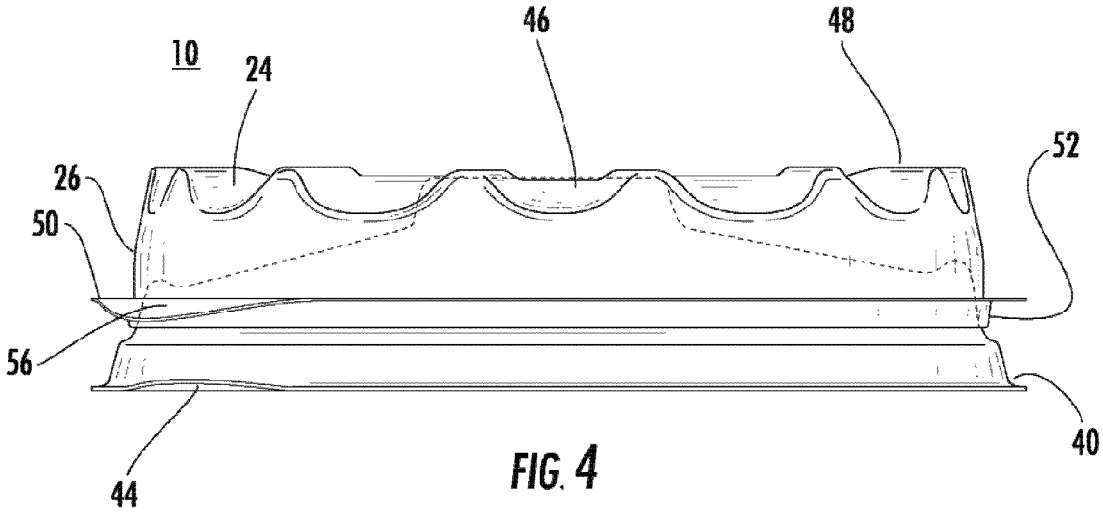
FIG. 4 is a side view of the food tray assembly of FIG. 1, shown in a transport configuration.

However, during transport of the food tray assembly 10 from one location to another, the food tray assembly 10 may be configured differently. In this regard, FIG. 4 is a perspective view of the food tray assembly 10 in a transport configuration as opposed to the serving configuration thereof as shown in FIG. 1. In the transport configuration, the receptacle platter 14 is flipped upside down and placed over the serving platter 12 relative to the surface on which the food tray assembly 10 is placed. In this configuration, the receptacle platter 14 becomes a lid for the serving platter 12, such that food items disposed on the serving platter 12 are covered and protected from the environment and from being spilled during transport. In at least one preferred commercial embodiment, the receptacle platter 14 is fabricated of a translucent or transparent material so that food items disposed on the serving platter 12 may be viewed through the receptacle platter 14 during transport.

In another feature of the present invention, the indentations 48 in the bottom of the receptacle platter 14 provide a stabilizing structure when multiple tray assemblies 10 are stacked for transport. When two or more food tray assemblies 10 are placed into their transport configuration and stacked on top of each other, the indentations 48 of the receptacle platter 14 of the lower tray assembly 10 engage the underside 30 of the serving platter 12 of the upper tray assembly 10, and more specifically, the underside of the radial channels 38 of the serving platter 12. As such, carrying multiple tray assemblies in the transport configuration is more stable than if the receptacle platter 14 did not include indentations 48.

In view of the foregoing, the serving platter 12 and receptacle platter 14 may thus be releasably coupled together in more than one configuration. In particular, such couplings may be facilitated as follows. To achieve the serving configuration, the raised portion 42 of the lip 40 of the serving platter 12 may be releasably coupled with the raised portion 52 of the lip 50 of the receptacle platter 14, as shown in FIG. 1. The two raised portions 42,52 are configured to releasably couple to one another with a friction fit. The separation tabs 44,56 on the respective components aid in separating said components from one another. Further, the serving platter 12 and receptacle platter 14 are preferably designed for nesting in similar serving platters and receptacle platters with a preferred nesting allowance of about a quarter of an inch.

In use, the serving platter 12 is first loaded with the desired food items, e.g., chicken wings, typically in a kitchen or other food preparation area of a restaurant or the like, by placing the food items in the radial channels 38 thereof. If a container 36 holding dipping sauce is to be provided with the food items, it may be placed in the central aperture 16. The receptacle platter 14 is then inverted and coupled on top of the serving platter 12 as described previously so that the tray assembly 10 may be transported to the dining area, which may be a table in a restaurant, a consumer's own kitchen at home, or any other location at which food may be consumed. Because the receptacle platter 14 is preferably translucent or transparent, a user will be able to see the food items located on the serving platter 12 during transport. This is particularly advantageous in the food service industry for the situation wherein users are take-out customers. The customer will be able to view his order to make sure that it is accurate without having the remove the receptacle platter 14.

At the dining area, the tray assembly 10 may be prepared for use as follows. First, the receptacle platter 14 may be removed by a waitperson, a diner, or the like. After removal, the receptacle platter 14 is turned over and coupled beneath the serving platter 12 as described previously. If a container 36 holding dipping sauce has been placed in the central aperture 16, it may be removed prior to eating the food items on the serving platter 12. After the food is eaten, food waste created by the food item, e.g., chicken wing bones, may be discarded by dropping the waste through the central aperture 16 of the serving platter 12.

In the chicken wing example, this allows a user to eat chicken wings located on the serving platter 12 and easily and neatly discard the bones through the central aperture 16 of the serving platter 12. The bones are collected in the receptacle platter 14, which is attached to the serving platter 12. As such, the bones are neatly contained within the receptacle platter 14 while the chicken wings are being eaten. When a user has finished eating the chicken wings, he is left with an eating area free of unsightly, messy bones. Further, the bones may be easily removed from the area by removing the entire tray assembly 10.

The bones may be disposed of in a waste receptacle in one of at least two ways. If the food tray assembly 10 is of a durable, reusable variety, the bones may be disposed of by decoupling the serving platter 12 from the receptacle platter 14 and throwing the bones in a waste receptacle. A person transferring the bones to the waste receptacle does not ever have to come into contact with the discarded bones. This is particularly advantageous in situations wherein the person disposing of the bones is not the same person that ate the chicken wings. On the other hand, if the food tray assembly 10 is of a nondurable, disposable variety, the entire assembly 10 may be disposed in the waste receptacle.

Of the two varieties, it is anticipated that the tray assembly 10 of FIGS. 1-4 is preferably a disposable tray assembly. The serving platter 12 and receptacle platter 14 may be fabricated from a variety of thermoplastic materials. Examples include polypropylene, polystyrene and polyethylene terephthalate (PET). They are preferably fabricated of vacuum formed polypropylene. Vacuum forming lends itself to forming relatively flexible components, and the components are well suited to being disposed of after a single use or limited number of uses. Alternatively, the serving platter 12 may be manufactured in a pulp molding process or in some other inexpensive manufacturing process. Pulp molding products are well known and include audio speaker cones and egg cartons. Pulp molding further enables low cost, three-dimensional branding as a result of the ability to selectively raise portions of the surface during the pulp molding.

A disposable tray assembly may be preferred for take-out customers of the food service industry. With the tray assembly 10 of the present invention, a customer is able to order a food item that is typically served in a restaurant on a serving platter and is able to eat the particular food item as he would eat it in the restaurant, i.e., on a serving platter. In addition, the customer is able to enjoy the benefit of discarding waste in the tray assembly's receptacle platter and is then able to dispose of the entire tray assembly after use.

Figure 5:
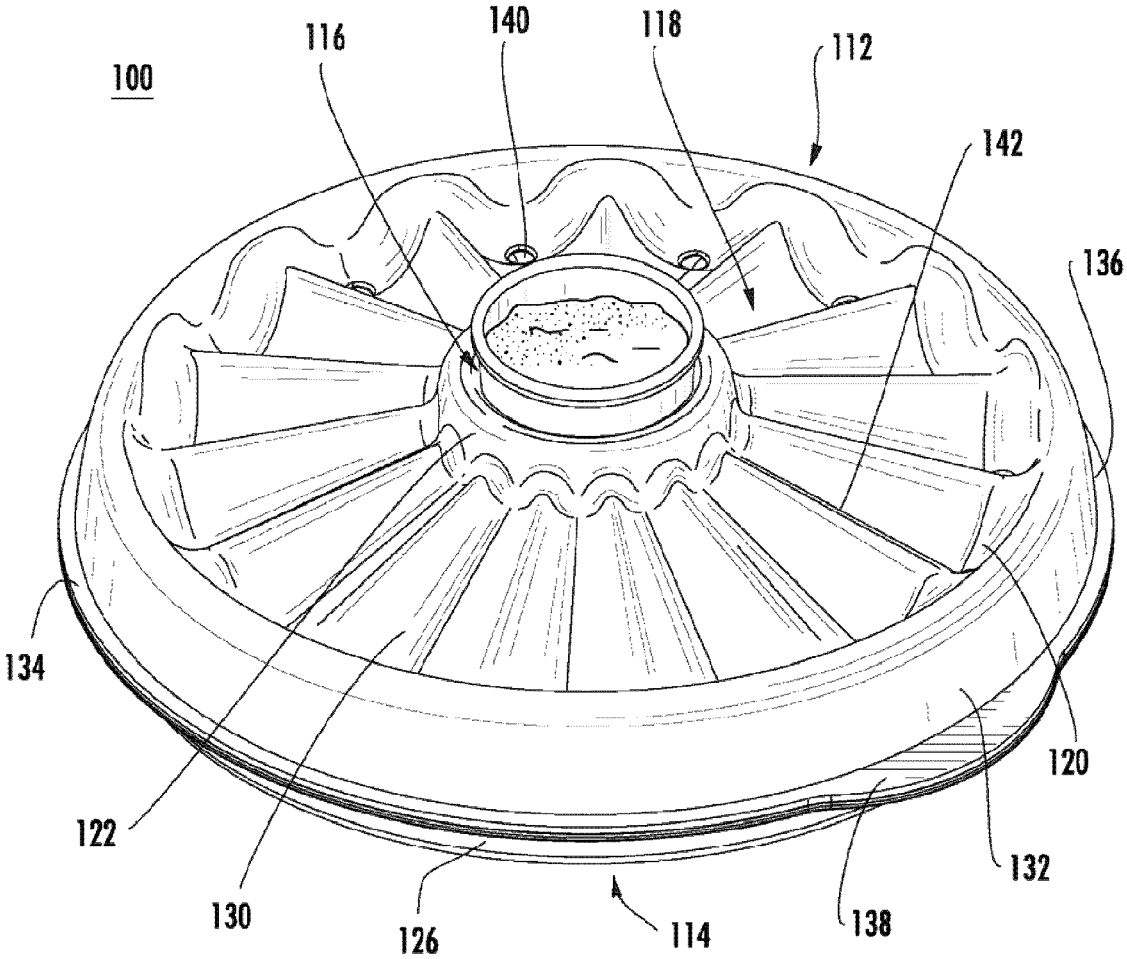
FIG. 5 is a perspective view of a food tray assembly, shown in a serving configuration, in accordance with another preferred embodiment of the present invention.

FIG. 5 is a perspective view of a food tray assembly 100, shown in a serving configuration, in accordance with another preferred embodiment of the present invention. This tray assembly 100 is intended to be more durable than the tray assembly 10 of FIGS. 1-4 and may be particularly suitable for repeated use. Similarly to the food tray assembly 10 of FIG. 1, the food tray assembly 100 includes a serving platter 112 and a receptacle platter 114. The serving platter 112 has a central aperture 116 disposed there through, a serving area 118 defined between the central aperture 116 and a perimeter 120 of the serving platter 112. The central aperture 116 is surrounded by a peripheral wall 122 extending there about. The receptacle platter 114 has a bottom 124 and a peripheral wall 126 extending from said bottom 124 at a perimeter 128 thereof. As shown in FIG. 5, the food tray assembly 100 is in a serving configuration, with the receptacle platter 114 being releasably coupled beneath the serving platter 112.

Figure 6:
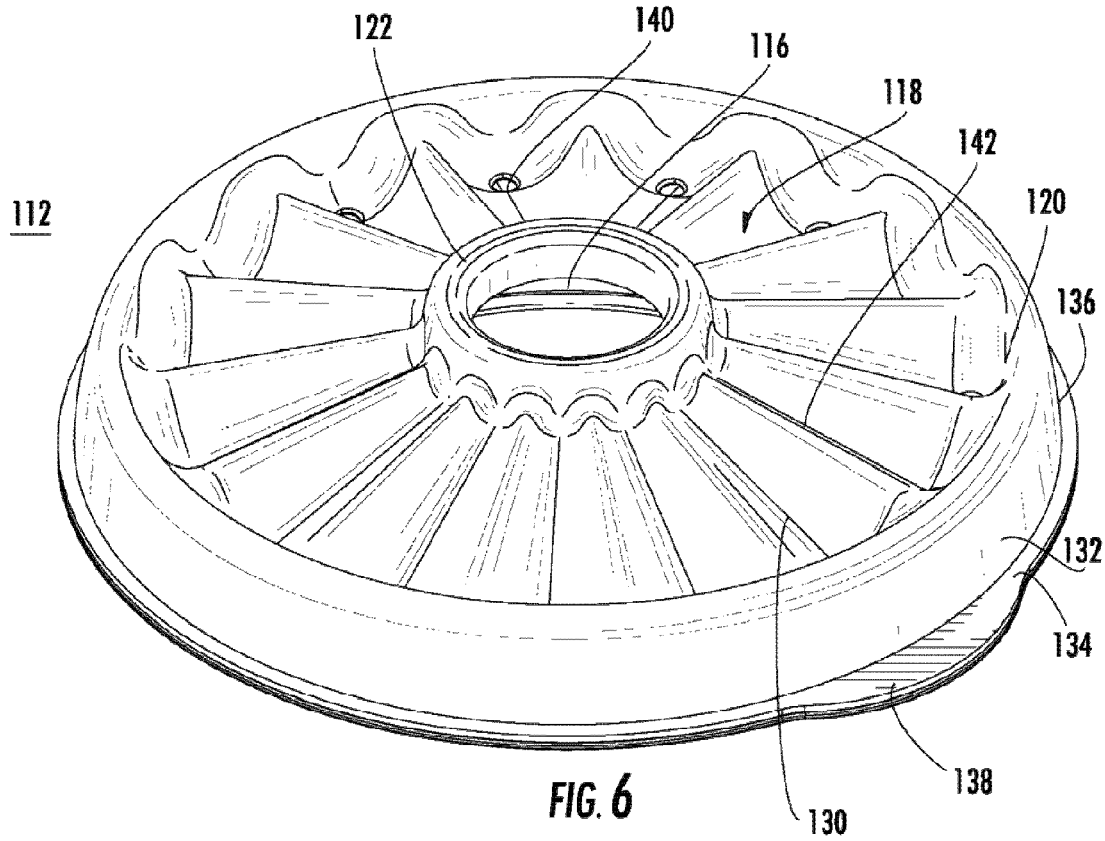
FIG. 6 is a perspective view of the serving platter of the food tray assembly of FIG. 4.

FIG. 6 is a perspective view of the serving platter 112 of the tray assembly 100 of FIG. 5. Similar to the serving platter 12 of FIG. 2, the serving platter 112 includes a plurality of radial channels 130 in the serving area 118 thereof. However, unlike the serving platter 12 of FIG. 2, this serving platter 112 includes a peripheral wall 132 disposed at the perimeter 120 of the serving platter 112 wherein the peripheral wall 132 provides an area for indicia to be placed, e.g., advertising indicia. A lip 134 is disposed at a lower rim 136 of the peripheral wall 132. The lip 134 facilitates releasable coupling with the receptacle platter 114. The lip 134 includes a separation tab 138.

The serving platter 112 further includes a respective drain opening 140 disposed at a base 142 of each radial channel 130 adjacent the peripheral wall 132. The drain openings 140 provide a means for any excess sauce or other liquids associated with the food items located on the serving platter 112 to drain into the receptacle platter 114.

Figure 7:
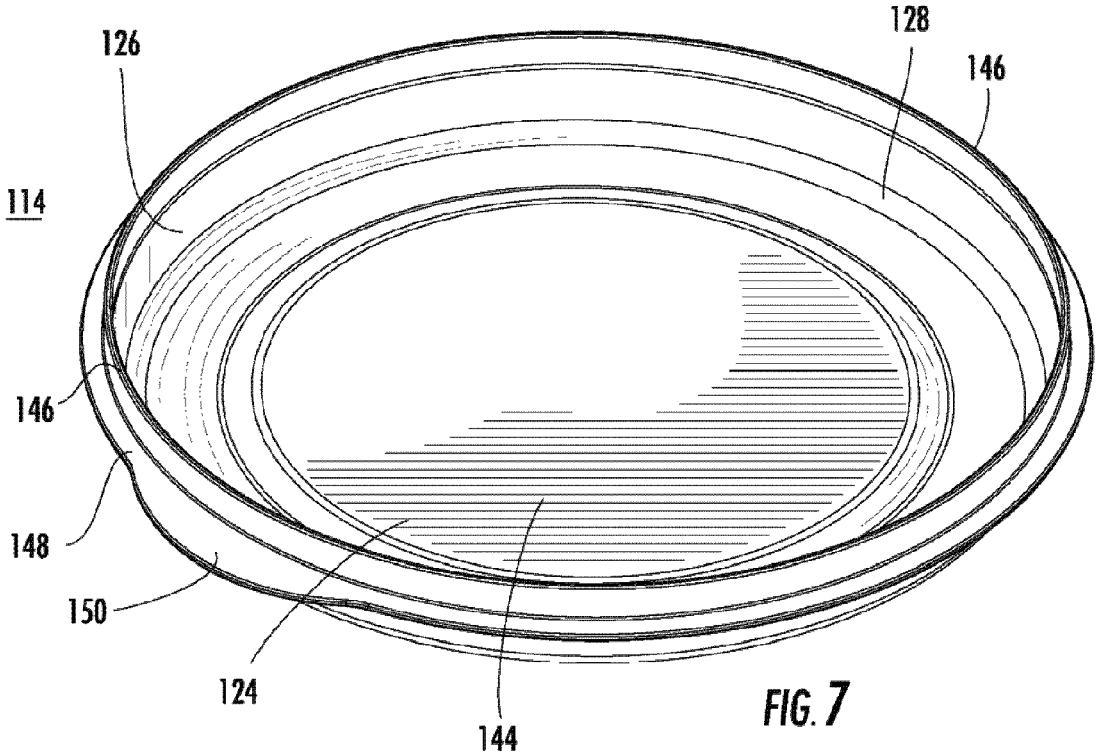
FIG. 7 is a perspective view of the receptacle platter of the food tray assembly of FIG. 4.

FIG. 7 is a perspective view of the receptacle platter 114 of the tray assembly 100 of FIG. 5. Unlike the receptacle platter 14 of FIG. 3, this receptacle platter 114 includes a generally planar central area 144 in the bottom 124 thereof. It is contemplated that this embodiment of the tray assembly 100 will generally not be stacked, therefore, indentations are not present in the receptacle platter 114. In addition, the planar central area 144 may lend itself to easier washing for multiple uses. The peripheral wall 126 includes a rim 146 and a support shelf 148 adjacent the rim 146. The support shelf 148 extends a slight distance outwardly from the peripheral wall 126. The support shelf 148 includes a separation tab 150. The support shelf 148 provides a support location for the lip 134 of the serving platter 112, thereby making the coupled tray assembly 100 more sturdy and secure.

In this embodiment, the serving platter 112 and receptacle platter 114 are preferably durable and rigid and are formed in one or more molding processes. The molding processes may include injection molding, rotational molding, and/or blow molding. It is further preferred that the serving platter and receptacle platter are injection molded polypropylene.

The durable, rigid serving platter 112 and receptacle platter 114 form a tray assembly 100 that is preferably a washable embodiment of the present invention. Because of the sturdy construction, the tray assembly 100 may be used multiple times with washings between uses. As such, this embodiment may be preferred for commercial food service establishments, such as restaurants, to be used by dine-in customers.

Figure 8:
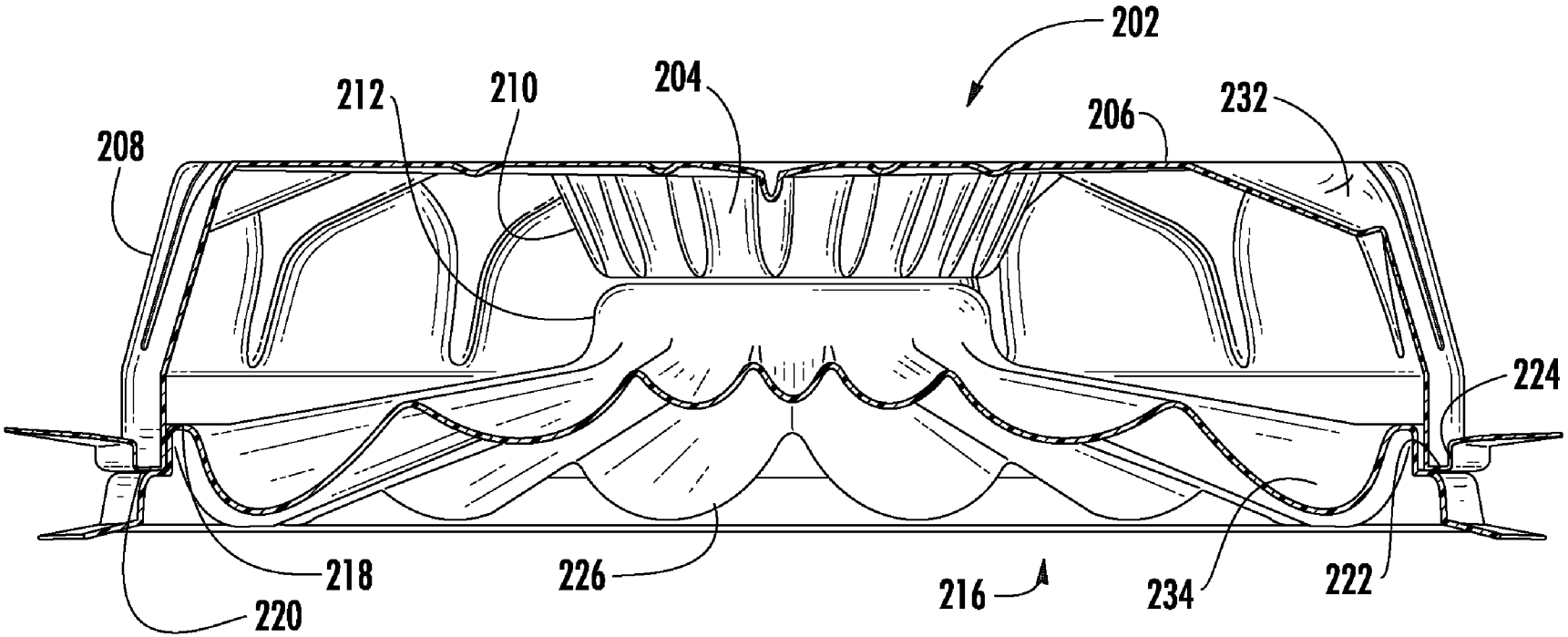
FIG. 8 is a side cross-sectional view of a food tray assembly, shown in a transport configuration, in accordance with an alternative embodiment of the present invention.
Figure 9:
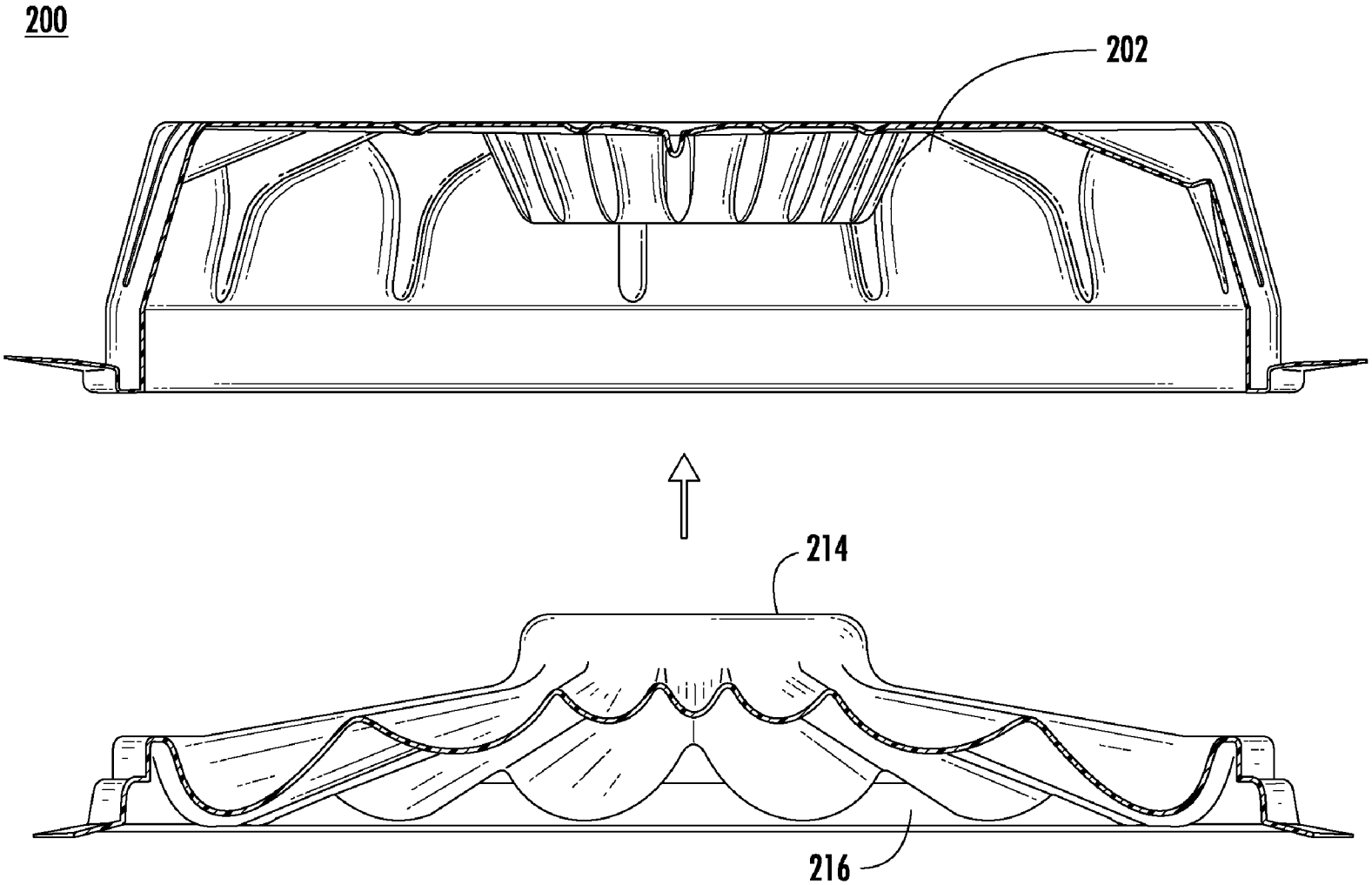
FIG. 9 is a side cross-sectional view the food tray assembly of FIG. 8, illustrating the receptacle platter and the serving platter being uncoupled from one another.
Figure 10:
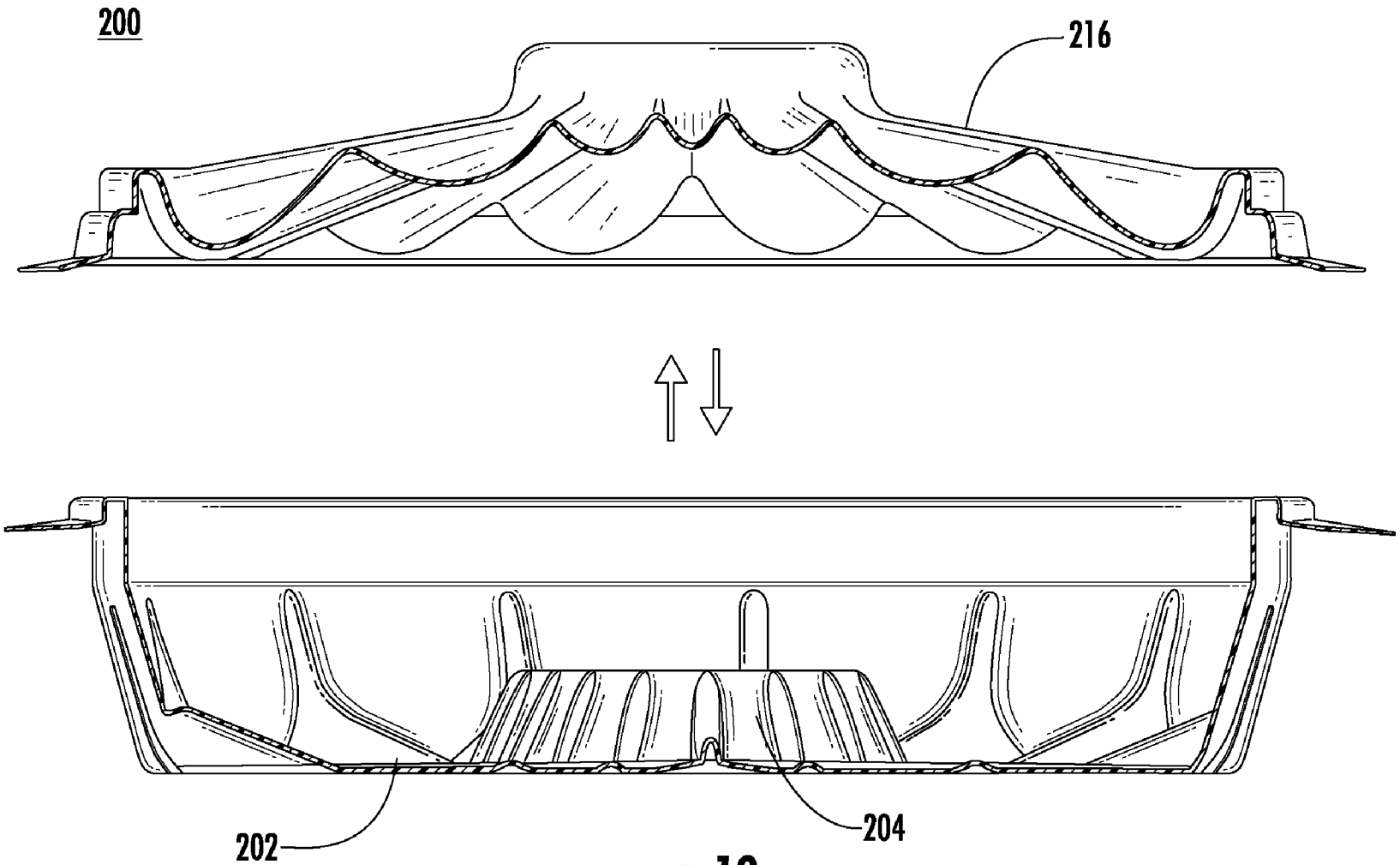
FIG. 10 is a side cross-sectional view of the food tray assembly of FIG. 8, illustrating the receptacle platter being positioned below the serving platter.

FIG. 8 is a side cross-sectional view of an alternative embodiment of a food tray assembly 200 in the transport configuration; FIG. 9 is a side cross-sectional view of the food tray assembly 200 of FIG. 8, illustrating the receptacle platter 202 being uncoupled from the serving platter 216; and FIG. 10 is a side cross-sectional view of the food tray assembly 200 of FIG. 8, illustrating the receptacle platter 202 being disposed below the serving platter 216. Like previous embodiments, the food tray assembly 200 of FIG. 8 includes a receptacle platter 202 and a serving platter 216. The receptacle platter 202 has a centrally disposed platform 204 extending upwardly from a bottom 206 thereof when the receptacle platter 202 is in its serving configuration (as shown in FIG. 10). In this embodiment, a peripheral wall 208 of the receptacle platter 202 is relatively deeper than the peripheral wall 26 of the receptacle platter 14 of previous embodiments. The raised platform 204 is generally circular and has a wall 210 having a depth less than the depth of the peripheral wall 208 of the receptacle platter 202. The central raised platform 204 of the receptacle platter 202 provides an additional stabilizing structure for the food tray assembly 200 in the transport configuration. More particularly, the wall 210 of the central raised platform 204 is supported by a peripheral wall 212 of a central aperture 214 of a serving platter 216 when the food tray assembly 200 is in the transport configuration, as shown in FIG. 8. Such additional support provides a food tray assembly 200 that is relatively more stable during transport.

Similarly to the embodiments described herein above, the serving platter 216 and receptacle platter 202 of the present embodiment may be releasably coupled to one another in the transport configuration. The serving platter 216 includes a raised portion 218 at a lip 220 thereof that may be releasably coupled to a raised portion 222 of a lip 224 of the receptacle platter 202. The two raised portions 218,222 are configured to releasably couple to one another with a friction fit.

As noted previously, the food tray assembly 200 in FIG. 8 is in a transport configuration. In this configuration, the receptacle platter 202 serves as a lid for the serving platter 216, such that food items disposed on the serving platter 216 are covered and protected from the environment and from being spilled during transport.

When a user reaches the location where food disposed on the serving platter 216 is to be eaten, the user will want to transition the food tray assembly 200 from the transport configuration to a serving configuration. The serving platter 216 and receptacle platter 202 may be released from one another, as shown in FIG. 9, and then the receptacle platter 202 flipped upside down and disposed below the serving platter 216, as shown in FIG. 10.

Figure 11:
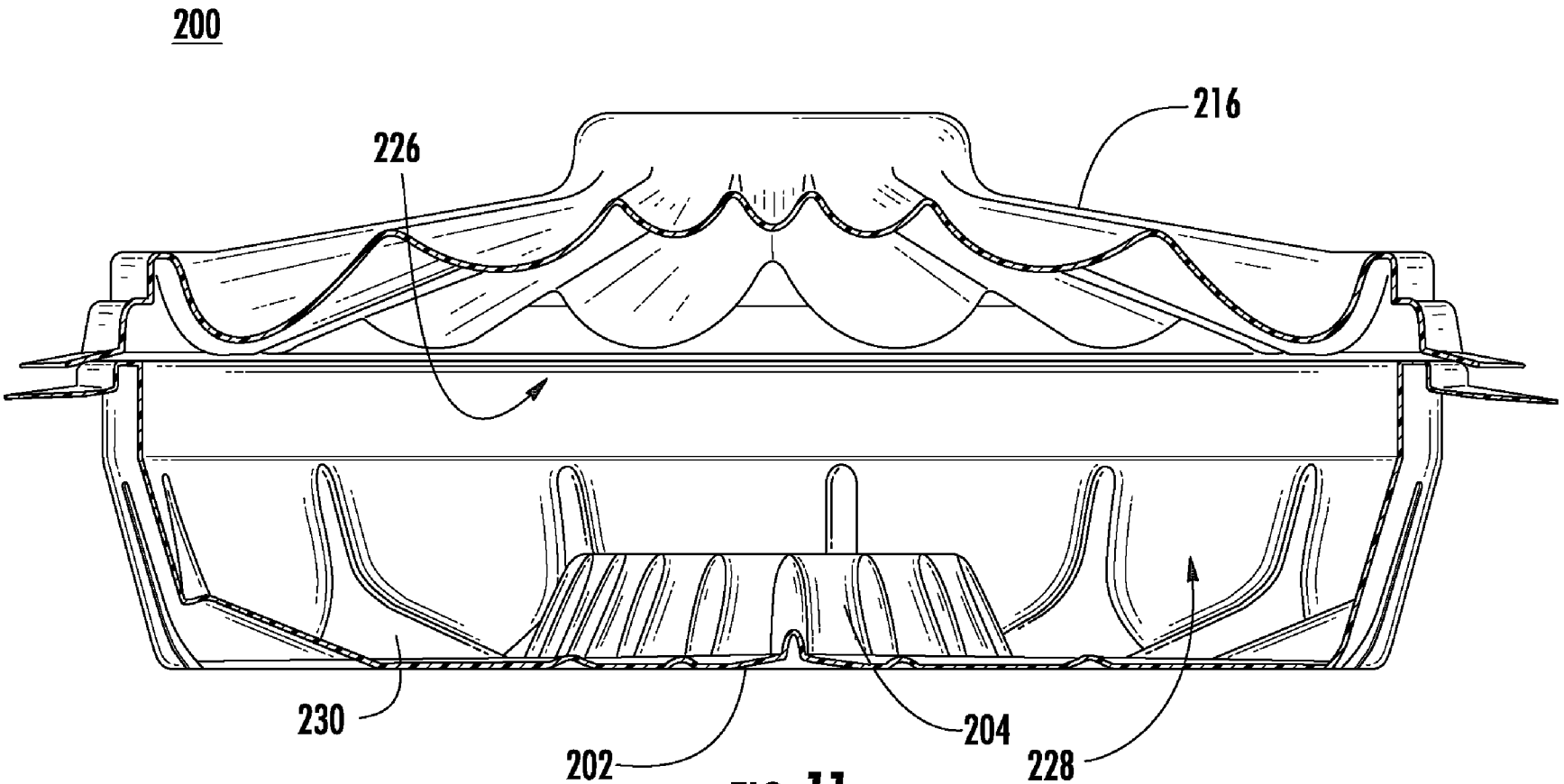
FIG. 11 is a side cross-sectional view of the food tray assembly of FIG. 8, shown in a serving configuration.

FIG. 11 is a side cross-sectional view of the food tray assembly of FIG. 8 in the serving configuration. In the serving configuration, an underside 226 of the serving platter 216 is in opposing facing relation with an interior bottom surface 230 of the receptacle platter 202. In the serving configuration, a void space 228 is present between the underside 226 of the serving platter 216 and the interior bottom surface 230 of the receptacle platter 202.

Figure 12:
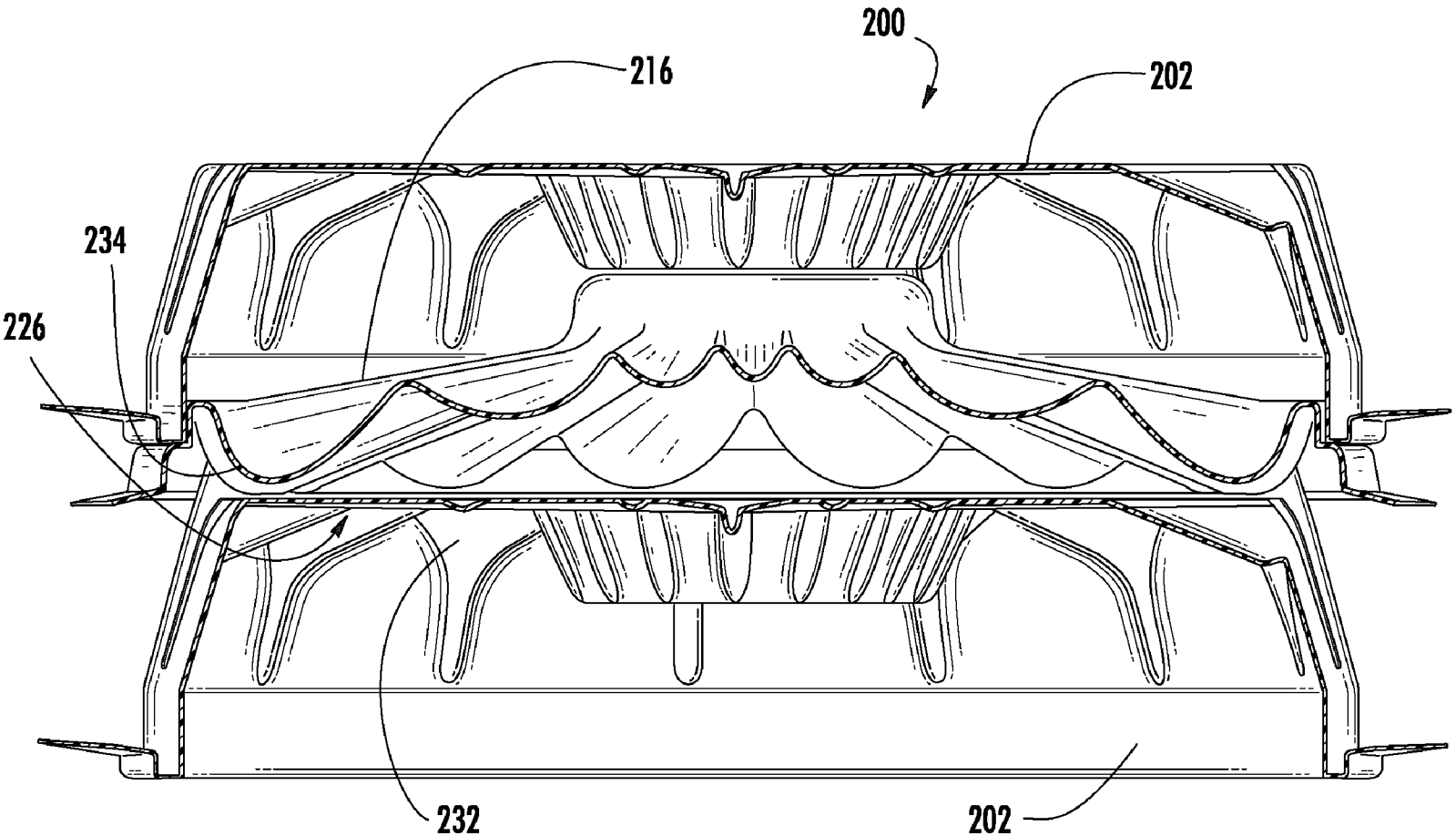
FIG. 12 is a side cross-sectional view of the food tray assembly of FIG. 8, shown in a transport configuration, with an additional receptacle platter in a transport orientation positioned there below.

FIG. 12 is a cross-sectional view of the food tray assembly 200 in the transport configuration with the receptacle platter 216 of an additional food tray assembly 200 in a transport orientation disposed there below. FIG. 12 provides an illustration of how more than one food tray assembly 200 in a transport configuration would stack for transport. Indentations 232 in the bottom 206 of the receptacle platter 202 provide a stabilizing structure when multiple tray assemblies 200 are stacked for transport. When two or more food tray assemblies 200 are placed into their transport configuration and stacked on top of each other, the indentations 232 of the receptacle platter 202 of the lower tray assembly 200 engage the underside 226 of the serving platter 216 of the upper tray assembly 200, and more specifically, the underside of radial channels 234 of the serving platter 216. As such, carrying multiple tray assemblies 200 in the transport configuration is more stable than if the receptacle platter 202 did not include indentations 232. In addition, and as mentioned previously, the central raised platform 204 of the receptacle platter 202 provides a further stabilizing structure for the food tray assembly 200 in the transport configuration, particularly when multiple tray assemblies 200 are stacked for transport.

Figure 13:
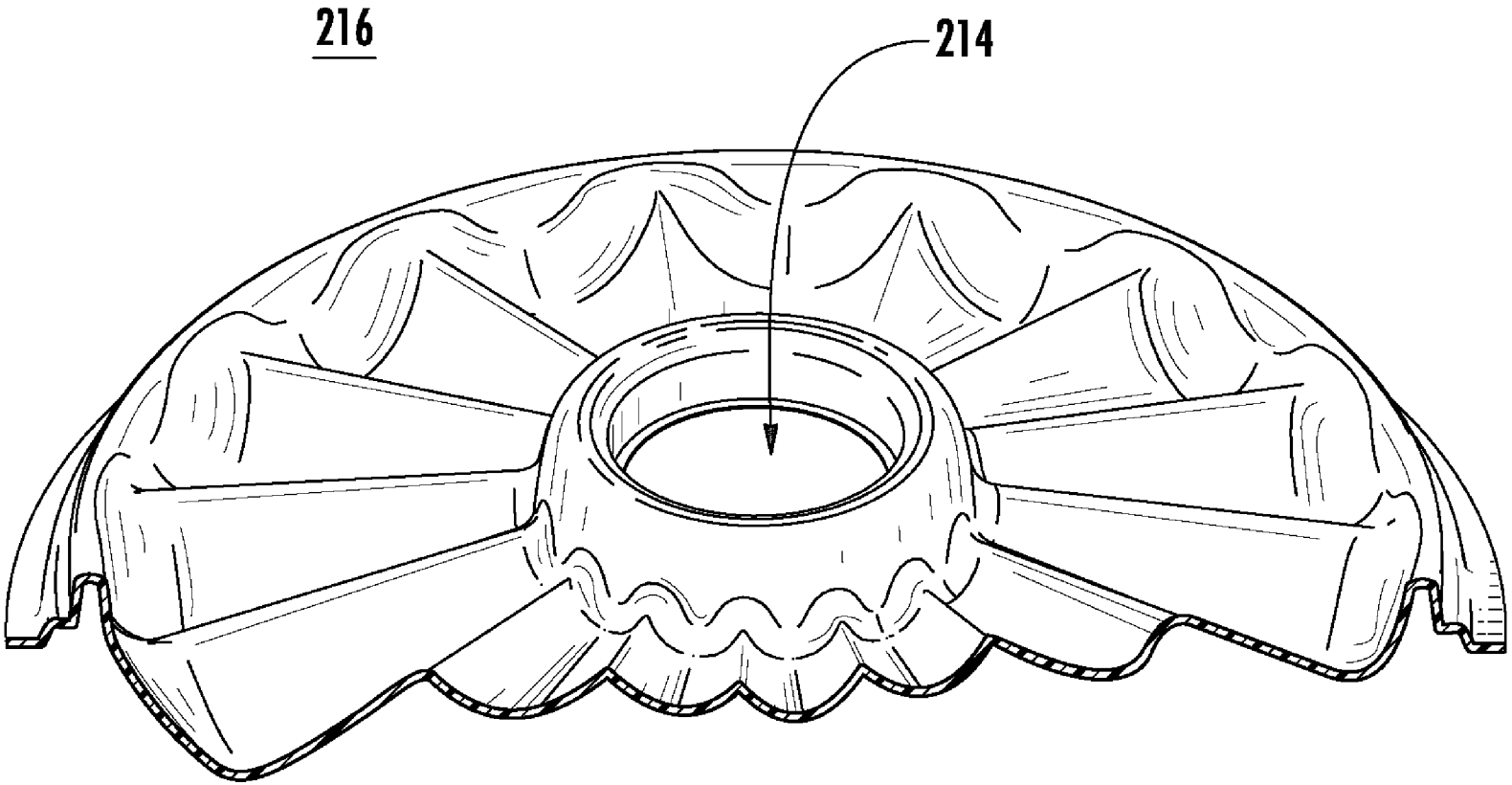
FIG. 13 is a perspective fragmentary view of the serving platter of the food tray assembly of FIG. 8.

FIG. 13 is a perspective fragmentary view of the serving platter 216 of the food tray assembly 200. The serving platter 216 is very similar to the serving platter 12 of the food tray assembly 10 of previous embodiments. However, it is contemplated that the serving platter 216 of this embodiment would include radial channels 234 capable of accommodating more than one individual item of food, e.g., more than one chicken wing. For a serving platter 216 displaying chicken wings, it is preferred that each radial channel 234 be able to accommodate two chicken wings. Accordingly, a serving platter 216 having twelve radial channels 234 would be able to accommodate twenty four chicken wings.

Figure 14:
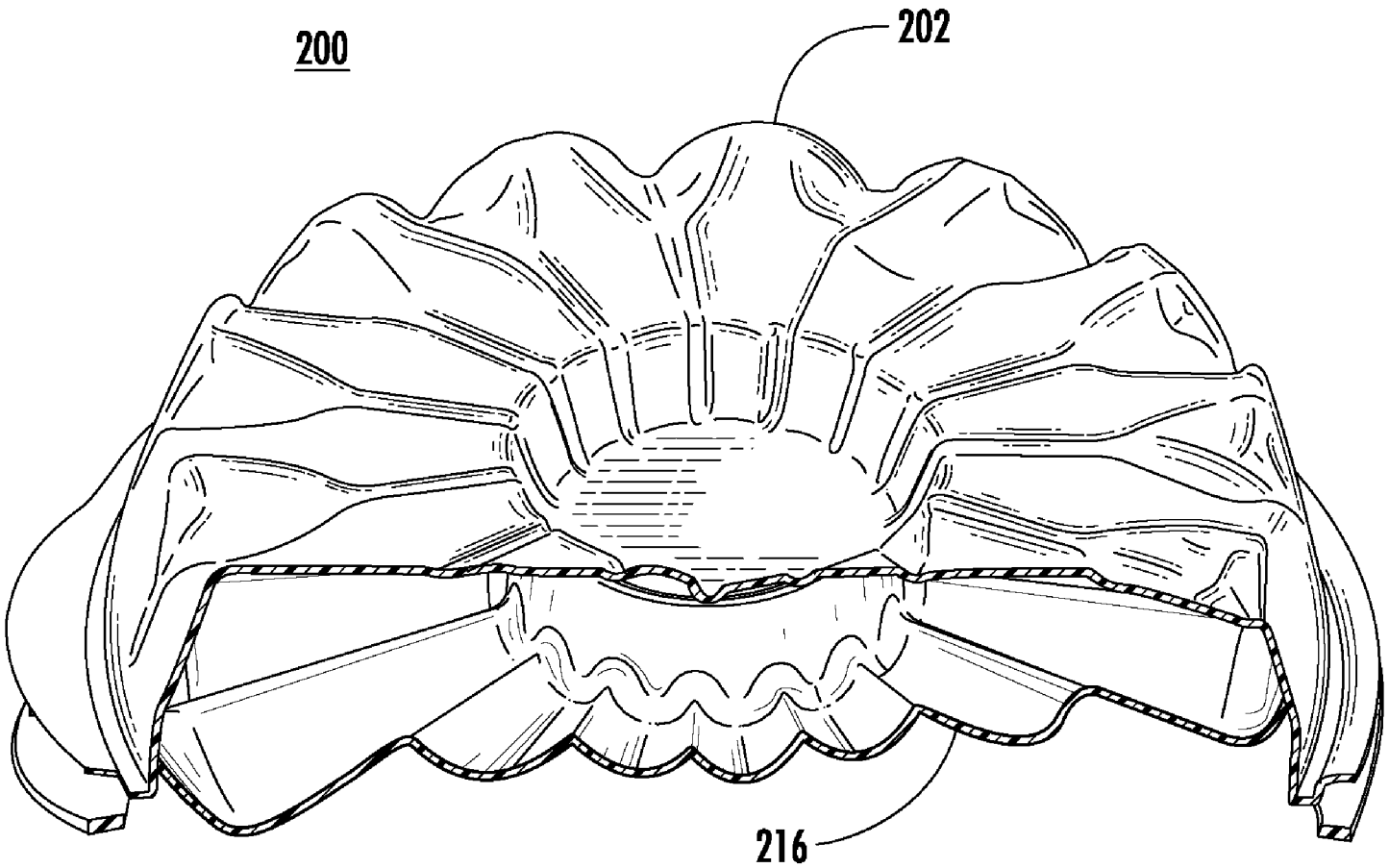
FIG. 14 is a perspective fragmentary view of the food tray assembly of FIG. 8.

FIG. 14 is a perspective fragmentary view of the food tray assembly 200 of FIG. 8. As is illustrated in FIG. 14, the central aperture 214 of the serving platter 216 is covered by the central raised platform 204 of the receptacle platter 202 when the food tray assembly 200 is in the transport configuration. As such, the central raised platform 204 provides a sealing surface prohibiting environmental contaminants from contacting food items arranged on the serving platter 216 during transport. The raised central platform 204 assists in ensuring that food being transported by the food tray assembly 200 is completely sealed off from the environment.

It is anticipated that the tray assembly 200 is preferably a disposable tray assembly. Similarly to the disposable tray assembly discussed above, the serving platter 216 and receptacle platter 202 may be fabricated from a variety of thermoplastic materials. Examples include polypropylene, polystyrene and polyethylene terephthalate (PET). They are preferably fabricated of vacuum formed polypropylene. Vacuum forming lends itself to forming relatively flexible components, and the components are well suited to being disposed of after a single use or limited number of uses.

Multiple variations of the food tray assemblies 10, 100, 200 are also possible without departing from the scope of the present invention. For example, a food tray assembly may be manufactured as a single, integral piece rather than as two components. The serving platter may be formed or otherwise manufactured in novel shapes. One exemplary shape may be a steamboat, wherein the central aperture is contained within the smokestack of the steamboat. Another exemplary shape may be a volcano wherein the central aperture is the mouth of the volcano.

Each of the various tray assemblies of the present invention provides a convenient place to discard food waste at a dining area while the food is being eaten. The receptacle platter conveniently contains the food waste and keeps it out of sight of a user while he is eating. Once a person has finished eating, the entire tray assembly may be easily removed from the dining area. Further, the food waste may be easily disposed of in a traditional trash receptacle without the user having to come into contact with the food waste. Furthermore, disposable embodiments of the tray assembly provide a sealing lid that enables transport of food items from one location to another. In such embodiments, the receptacle platter conveniently serves as a lid for the tray assembly during transport and then as a holder for collecting food waste while the food is being eaten.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

VII. DISCLOSURE OF INCORPORATED PATENT APPLICATION 60/596,367

Several preferred embodiments of a serving tray in accordance with the present invention are illustrated in FIGS. 15-17. The illustrated embodiments of the serving tray each includes a pan and removable lid. Each of these serving trays is intended to present items of food and, preferably, finger food, such as appetizers and the like. Such food may include poultry items such as chicken or "buffalo" wings, "tail-on" shrimp, and shellfish. Such food items also may include meatballs and olives to the extent that the meatballs and olives toothpicks and the like, which are left over after consumption of the food item. Indeed, the serving tray is particularly useful for any finger food that creates its own waste, whether naturally or otherwise.

The two components of the serving tray, i.e., the lid and the pan, preferably are formed in thermoforming manufacturing processes or in ejection molding processes. The lid preferably is contoured and includes wells or troughs in which the food items are received. Preferably, a lid includes fifteen troughs, although more or less may be provided in the lid as desired. Each well preferably includes a span of approximately one inch at the top and two inches at the bottom when the serving tray is to accommodate chicken wings.

The lid preferably snaps or otherwise attaches to the pan in the area of the rim thereof in a friction fit. Furthermore, in a related feature, the lid preferably includes a separation tab to facilitate separation of the lid and the pan.

The pan and lid each preferably are designed for nesting in similar pans and lids. The nesting allowance preferably is about a quarter of an inch.

The lid also includes an opening and, as shown in the drawings, a center opening. The center opening in the lid of the serving tray preferably is about two and one-half inches in diameter.

In a feature (not shown in FIGS. 15-17), a cup of sauce or dip is dimensioned to removably fit within the center opening for carriage of the serving tray. The cup then can be removed for dipping of food items and for access to the center opening for disposal of the resulting waste.

In another feature, an annular container is dimensioned to fit on top of the perimeter of the center opening of the lid without obstructing the center opening. The annular container includes a circular recessed area for dip or sauce and may be partitioned for holding various dips or sauces.

The pan preferably includes a dome-shaped bottom such that any waste material that is received through the opening in the lid will move toward the perimeter of the pan and a waste pile will not form in the center. Distribution of the waste toward the perimeter of the pan will tend to avoid any piling of the waste in the center of the pan. Such distribution further tends to evenly balance the weight of the serving tray when carried after use.

The serving tray may be permanent or disposable. When disposable, the lid of the serving tray may be manufactured in a pulp molding process or in some other inexpensive manufacturing process. Pulp molding products are well known and include audio speaker cones and egg cartons. Pulp molding further enables low cost, three-dimensional branding as a result of the ability to selectively raise portions of the surface during the pulp molding.

In an embodiment of the serving tray shown in FIGS. 15-16, the pan serves the additional function of being a cover for the food items carried by and presented on the lid prior to consumption. In this regard, the pan is inverted and is removably attachable to the lid for transportation such as in "carry out" or delivery scenarios. In this, the lid preferably includes a transparent material that forms the bottom of the serving tray in the "serving" position and a top of the serving tray when in the "carry out" or "delivery" position covering the food items carried on and presented by the lid. The side wall of the lid, in contrast, preferably is not transparent, whereby waste is not visible when the serving tray is in the "serving" position.

In variations of the serving tray of the present invention, the serving tray may be manufactured as a single, integral piece rather than as two components. The lid further may include novel shapes, such as a steamboat, wherein the disposal openings are contained within the smokestack of the steamboat. Another novel shape comprises that of a volcano wherein the disposal opening comprises the mouth of the volcano.

What is claimed is:

1. A food tray assembly, comprising:

(a) a serving platter having (i) a disposal aperture disposed therethrough, and (ii) a serving area on a first side of the serving platter; and (b) a receptacle platter having (i) a bottom, and (ii) a peripheral wall extending therefrom;

(c) wherein the receptacle platter and the serving platter are configured to be releasably coupled together in two configurations, including (i) a serving configuration, in which the receptacle platter is releasably coupled to the serving platter such that (A) the first side of the serving platter generally faces upwards, (B) the peripheral wall of the receptacle platter extends generally upwards from the bottom of the receptacle platter, (C) the serving platter is disposed generally above the receptacle platter, and (D) items disposed via the disposal aperture are received and retained within an area collectively defined by the receptacle platter and the serving platter, and (ii) a transport configuration, in which the receptacle platter is releasably coupled to the serving platter such that (A) the first side of the serving platter generally faces upwards, (B) the peripheral wall of the receptacle platter extends generally downwards from the bottom of the receptacle platter, (C) the receptacle platter is disposed generally above the serving platter, (D) the receptacle platter covers the serving area of the food tray assembly, and (E) the receptacle platter covers the disposal aperture so as to generally seal off any items disposed in the serving area; and (d) wherein the food tray assembly can be transitioned from the transport configuration to the serving configuration by uncoupling the receptacle platter from generally atop the serving platter, inverting the receptacle platter, and coupling the receptacle platter generally below the serving platter.

2. The food tray assembly of claim 1, wherein the serving area of the serving platter includes a plurality of radial channels that collectively cover the whole of the serving area.

3. The food tray assembly of claim 2, wherein each channel of the plurality of radial channels is adapted to accept and retain more than one individual food item.

4. The food tray assembly of claim 1, wherein the serving area includes four radial channels.

5. The food tray assembly of claim 1, wherein the serving area includes twelve radial channels.

6. The food tray assembly of claim 1, wherein the serving area includes fifteen radial channels.

7. The food tray assembly of claim 1, wherein the serving platter includes a plurality of drain openings disposed adjacent a perimeter thereof.

8. The food tray assembly of claim 1, wherein the serving platter further comprises a wall defining and forming a periphery of the central aperture.

9. The food tray assembly of claim 1, wherein the central aperture is sized such that a container holding sauce for food disposed on the serving platter may be supported therein.

10. The food tray assembly of claim 1, wherein the plurality of indentations are generally triangular with a base of the triangle adjacent the receptacle platter perimeter.

11. The food tray assembly of claim 1, wherein the bottom of the receptacle platter includes a central raised platform.

12. The food tray assembly of claim 1, wherein the serving platter and receptacle platter are releasably coupled at a perimeter of the serving platter and a rim of the receptacle platter peripheral wall.

13. The food tray assembly of claim 1, wherein the serving platter includes a raised lip adjacent a perimeter thereof.

14. The food tray assembly of claim 1, wherein the receptacle platter includes a raised lip at a rim of the peripheral wall of the receptacle platter.

15. The food tray assembly of claim 14, wherein the raised lip of the receptacle platter is configured to releasably couple in a friction fit with a raised lip adjacent a perimeter of the serving platter.

16. The food tray assembly of claim 1, wherein the serving platter includes a tab extending from a perimeter thereof and the receptacle platter includes a tab extending from a rim of the peripheral wall.

17. The food tray assembly of claim 1, wherein the receptacle platter includes a tab extending from a rim of the peripheral wall.

18. The food tray assembly of claim 1, wherein the serving area of the serving platter slopes downwardly, relative to a surface on which the serving platter is placed, from the central aperture to a perimeter thereof.

* * * * *